US006644742B1

(12) United States Patent
Walser

(10) Patent No.: US 6,644,742 B1
(45) Date of Patent: Nov. 11, 2003

(54) SEATING ELEMENT FOR A SEATING ARRANGEMENT

(76) Inventor: Thomas Walser, Ober-Emmenweid 38, CH-6020 Emmenbrücke (CH)

( * ) Notice: Subject to any disclaimer, the term of this patent is extended or adjusted under 35 U.S.C. 154(b) by 0 days.

(21) Appl. No.: 09/936,955

(22) PCT Filed: Mar. 20, 2000

(86) PCT No.: PCT/CH00/00161

§ 371 (c)(1),
(2), (4) Date: Jan. 8, 2002

(87) PCT Pub. No.: WO00/56191

PCT Pub. Date: Sep. 28, 2000

(30) Foreign Application Priority Data

Mar. 18, 1999 (CH) ..... 0513/99
Sep. 23, 1999 (CH) ..... 1738/99

(51) Int. Cl.[7] ..... A47C 1/02

(52) U.S. Cl. ..... 297/314; 297/302.1; 297/452.41; 248/599

(58) Field of Search ..... 297/451.4, 451.5, 297/314, 344.1, 344.21, 195.1, 195.11, 215.13, 215.15, 302.1, 452.41; 248/562, 599

(56) References Cited

U.S. PATENT DOCUMENTS 186,570 A * 1/1877 Huffmanh
2,836,225 A 5/1958 Swenson
3,235,221 A * 2/1966 Conner
3,309,137 A * 3/1967 Wiebe
4,130,263 A * 12/1978 Roericht
4,234,152 A * 11/1980 Browse
4,438,919 A * 3/1984 Gamzo
5,044,587 A * 9/1991 Degen
5,746,481 A * 5/1998 Obermaier
6,213,553 B1 * 4/2001 Fitz

FOREIGN PATENT DOCUMENTS

DE 3201335 * 7/1983
DE 42 10 098 A 9/1993
DE 94 16 126.7 U 2/1995
DE 295 20 898 U 4/1996

* cited by examiner

*Primary Examiner*—Laurie K. Cranmer
(74) *Attorney, Agent, or Firm*—Cummings & Lockwood LLC

(57) ABSTRACT

The invention relates to a novel seating device (1) with an elastic support element (2), at least one support leg (3) and a seat element (4), wherein the support element (2) has a substantially toroidal support body (9) standing on the ground. One great advantage provided by the novel seating device is that upward and downward movements can be slightly dampened thereby substantially alleviating the load on the back. Slight circular movements can also be effected which have an especially prophylactic effect against possible back injuries.

14 Claims, 9 Drawing Sheets

SEATING ELEMENT FOR A SEATING ARRANGEMENT

CROSS-REFERENCE TO RELATED APPLICATION

This application claims priority to Swiss Patent Application No. CH 0513/99, filed Mar. 18, 1999, and to Swiss Patent Application No. CH 1738/99, filed Sep. 23, 1999.

Seating arrangements, commonly known as chairs or benches, are an indispensable aid for humans in order to be able to perform the most diverse work. Normally, a chair has four legs, a seat surface and a back rest. There are also chairs with a single leg, which are fastened to a support element resting on the floor. In the field of office furniture, in particular office chairs, the support element consists of a five-pointed star supported on rollers, and the seating height is adjustable by means of a telescopic displacement of the single leg. The seat surface itself is not movable. Lately a seating arrangement has appeared, wherein the tubes of the telescope are rotatable in respect to each other, because of which the seat surface permits slight circular movements. However, the support surface of this chair is not stable enough to permit larger movements.

The object of the present invention is now based on disclosing a seating arrangement wherein the right seating position is automatically assumed and strengthening of the muscles of the back is achieved. The seating arrangement is further intended to satisfy ergonomic and therapeutic requirements. The invention is further based on disclosing a seating element which is particularly suited to such a seating arrangement.

This object is attained by means of a seating arrangement with the characteristics of claim 1, or by a seating element with the characteristics of claim 11.

The seating arrangement of the invention has the large advantage that it is possible by means of it to perform springy up and down movements, which achieve a considerable relief for the back. It is also possible to perform slight circular movements, which is particularly prophylactic in regard to possible damage to the back in that now active strengthening of the muscles of the back is achieved. An upright seated posture is automatically assumed by means of the seating arrangement in accordance with the invention, because a wrong posture is noticeably less pleasant and must be immediately corrected. A further advantage of the seating arrangement in accordance with the invention is that its manufacture is particularly advantageous as to cost and is therefore within everybody's means.

Figure 1:
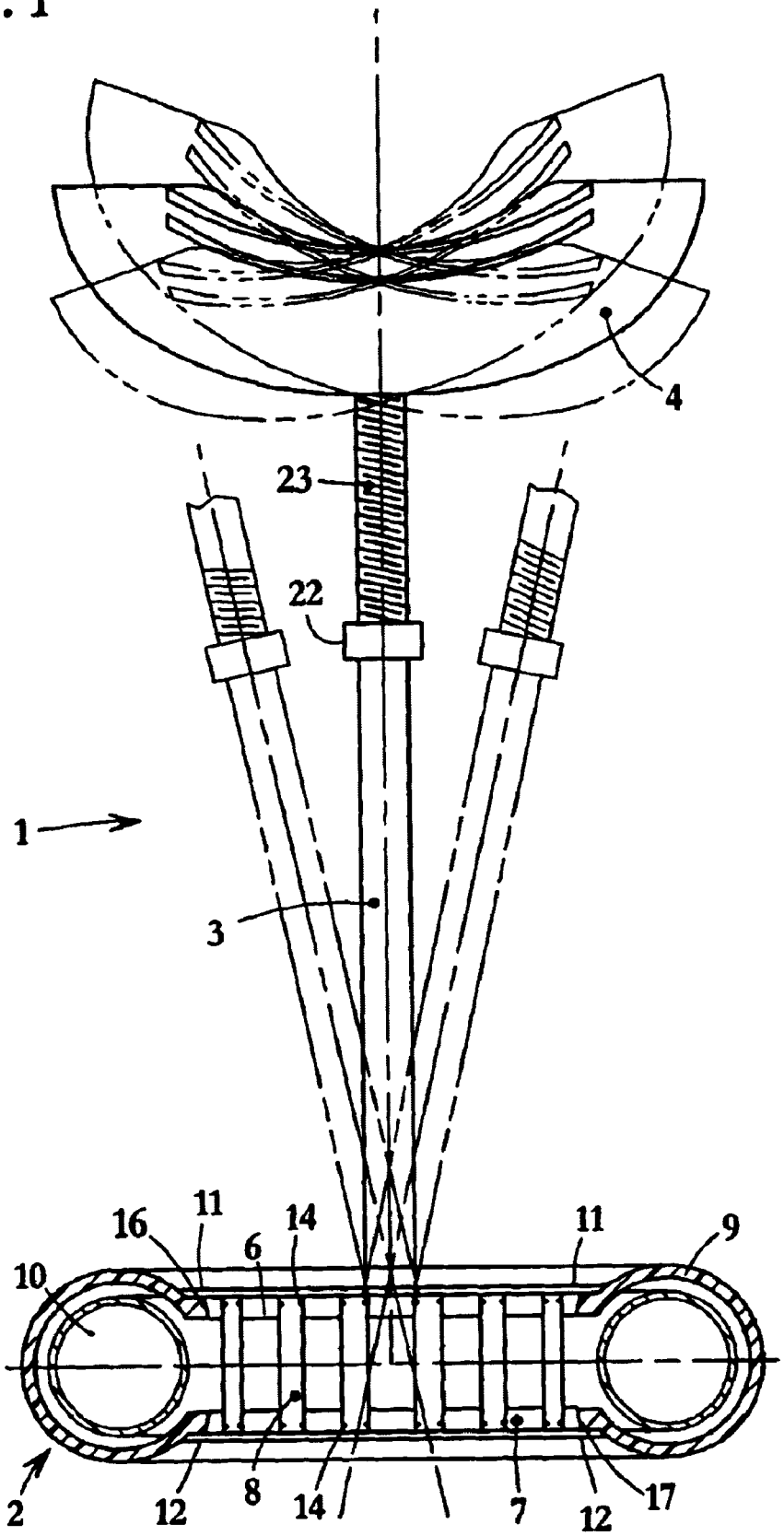
Figure 2:
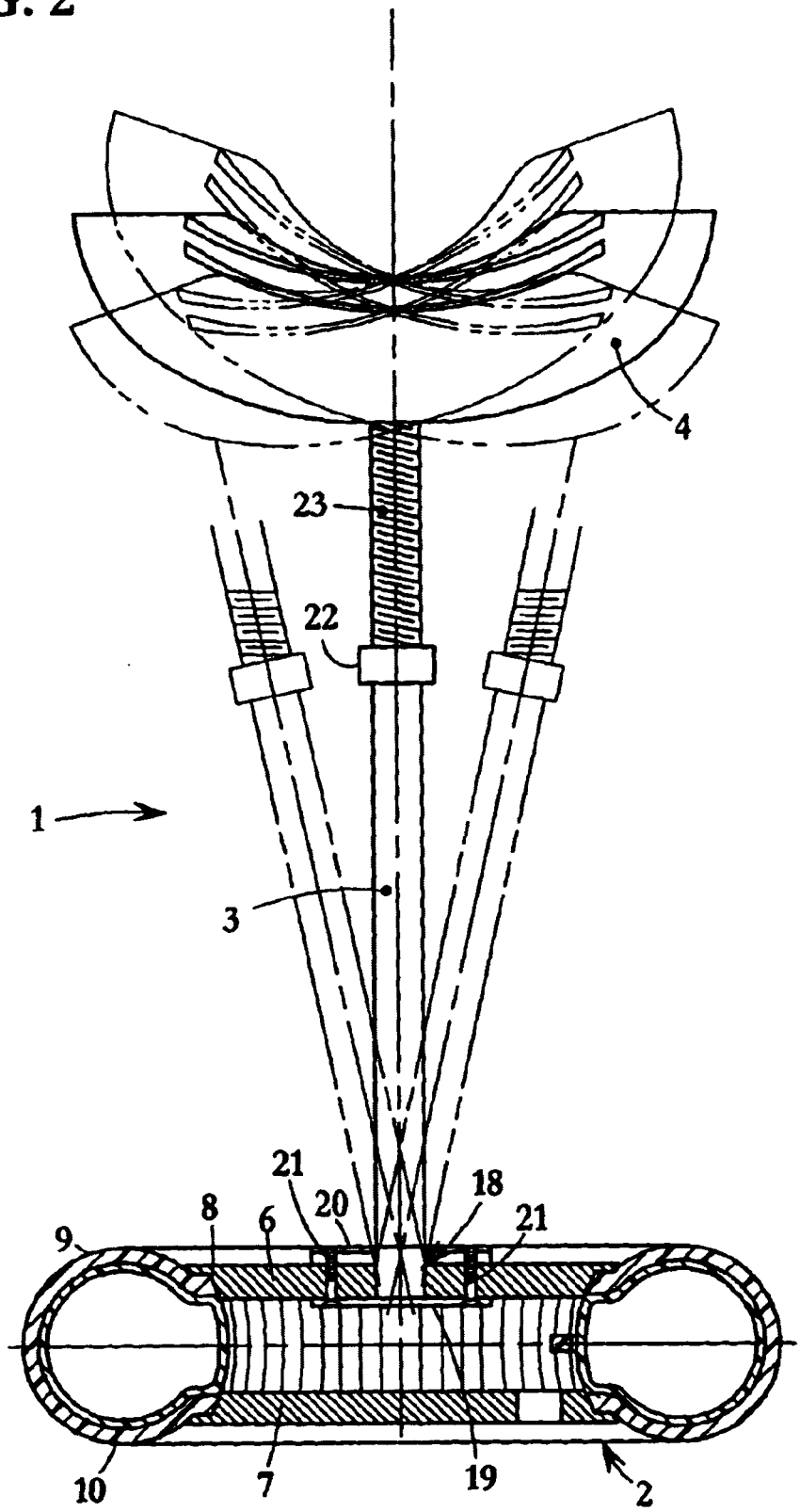
Figure 3:
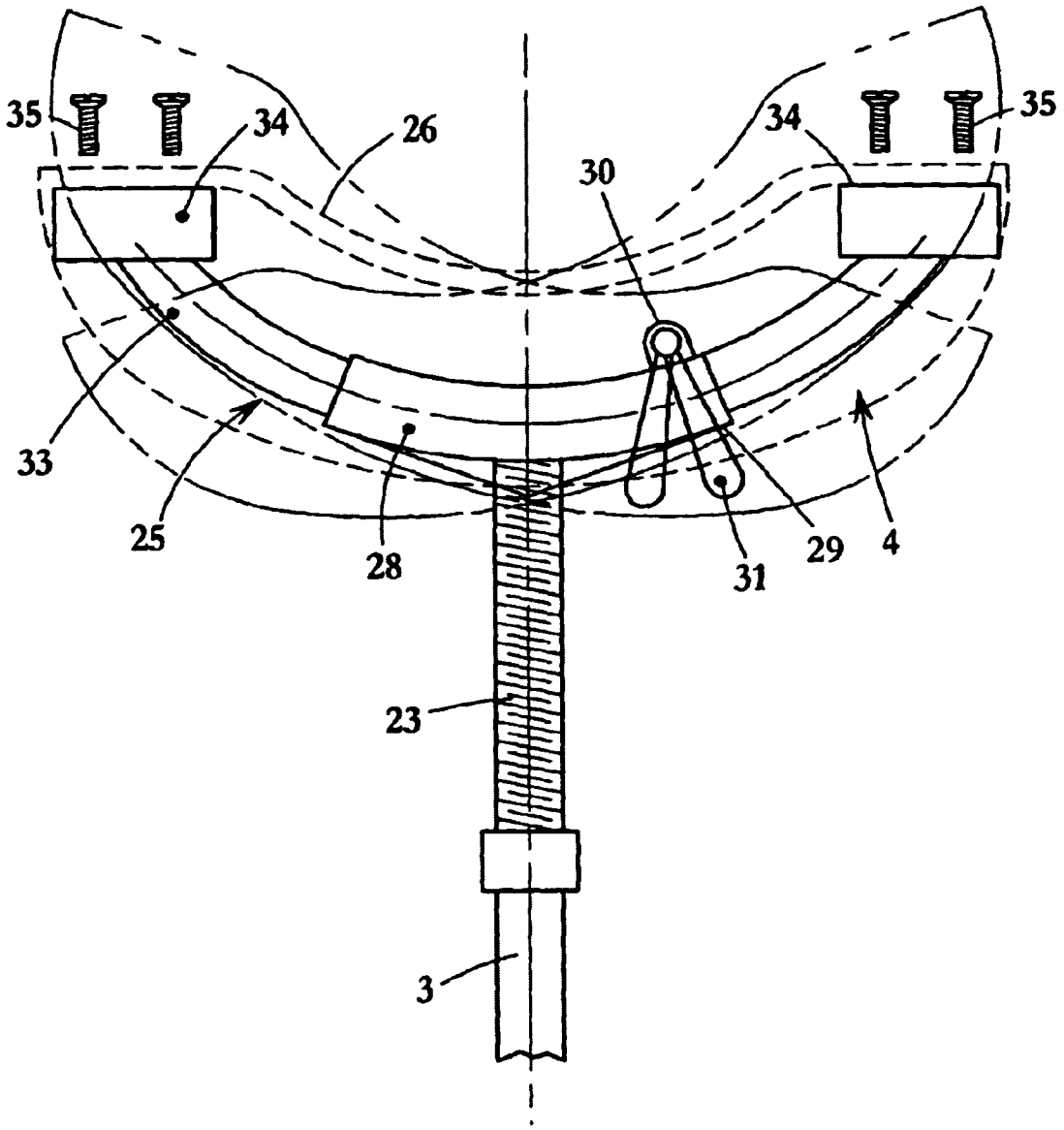
Figure 4A:
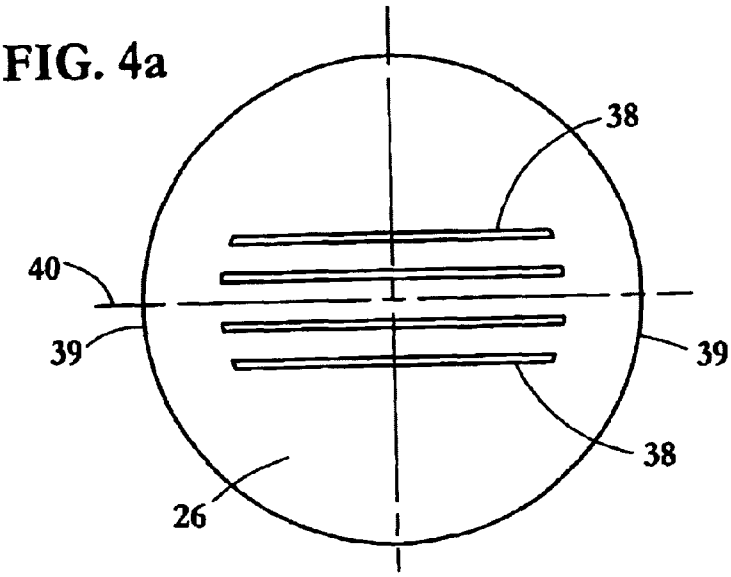
Figure 4B:
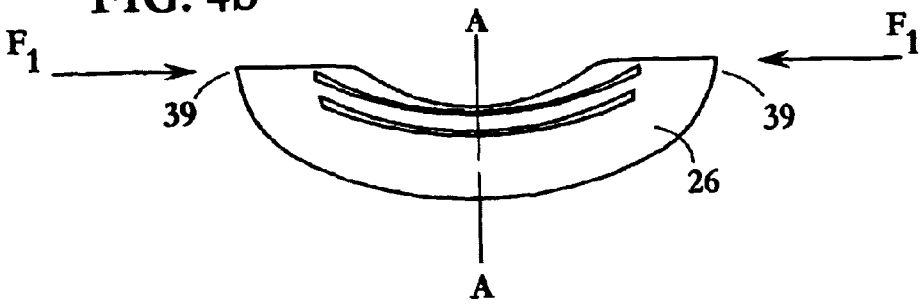
Figure 4C:
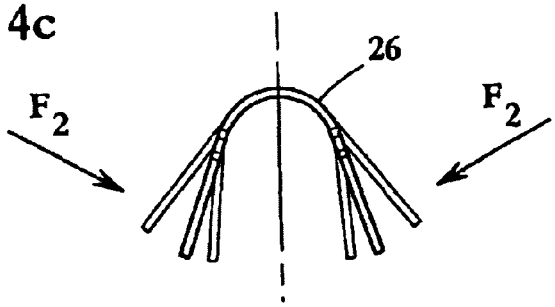
Figure 4D:
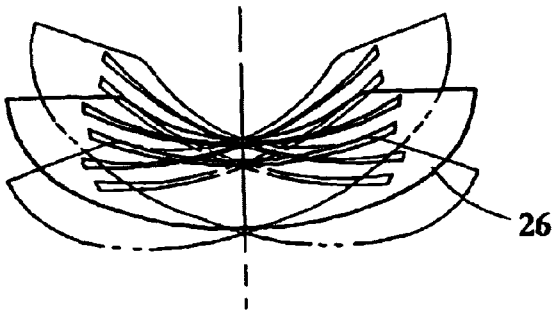
Figure 5:
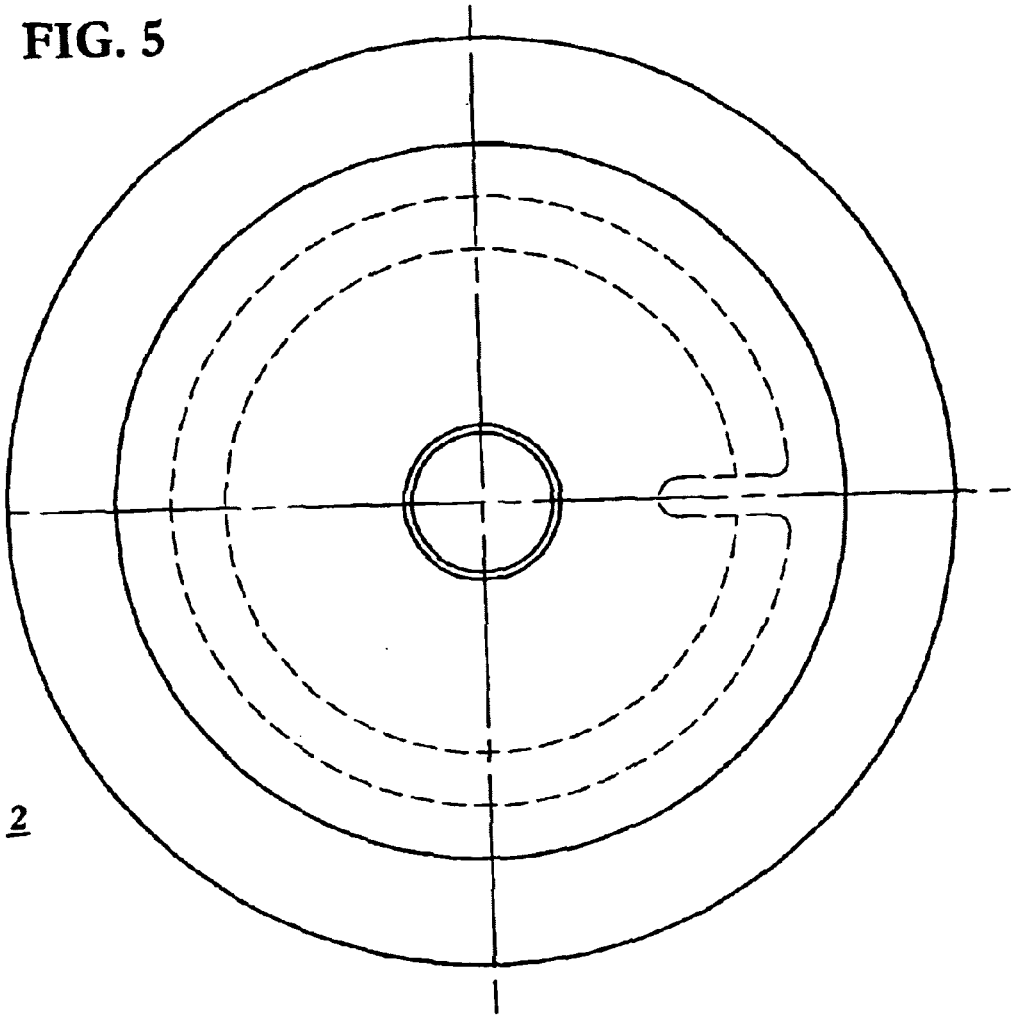
Figure 6:
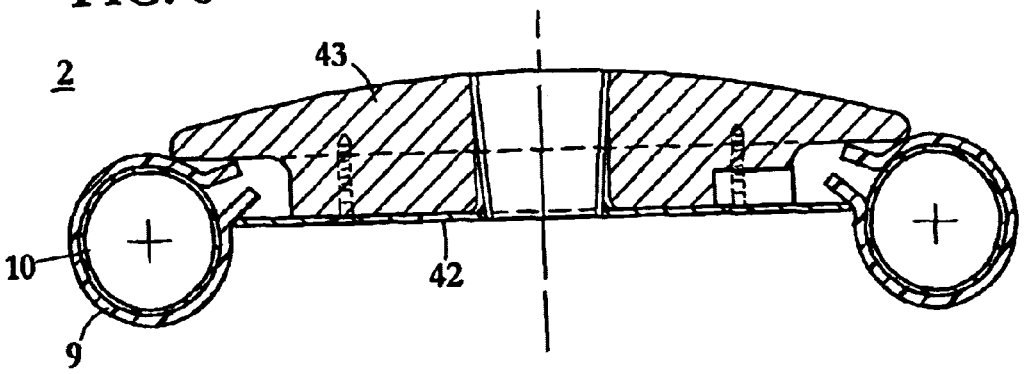
Figure 7:
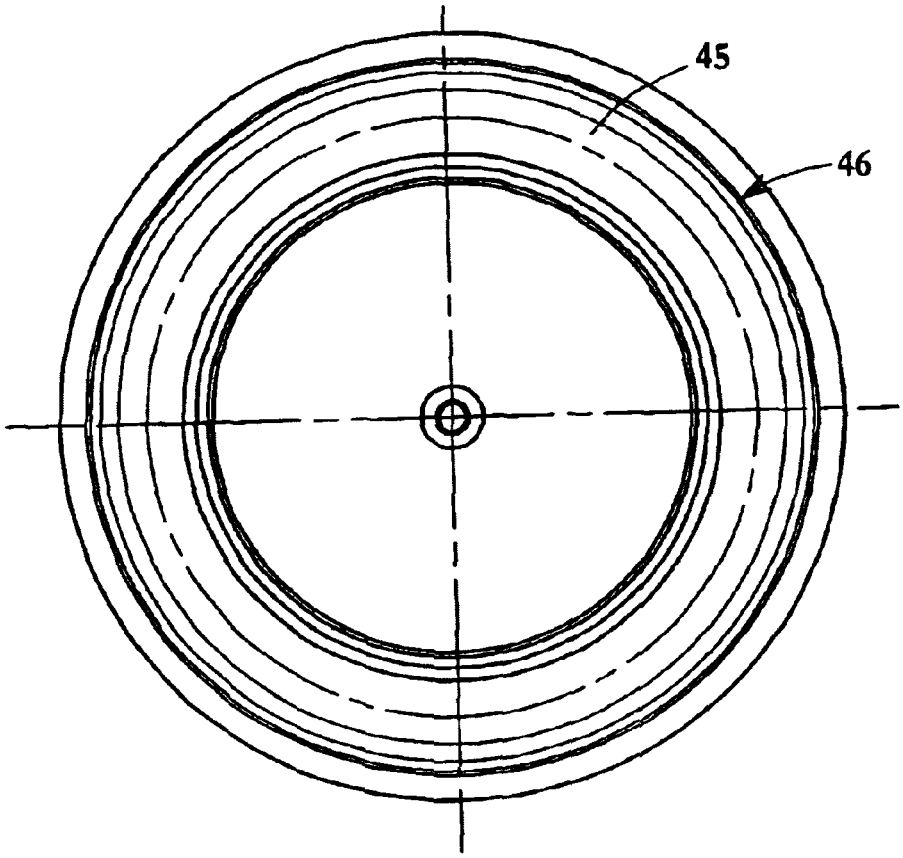
Figure 8:
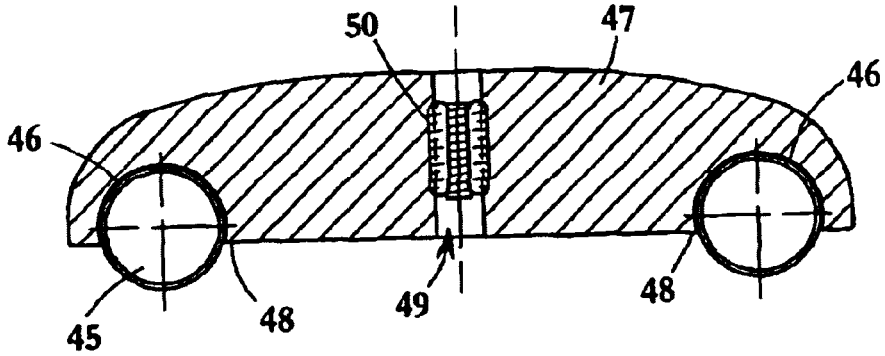
Figure 9:
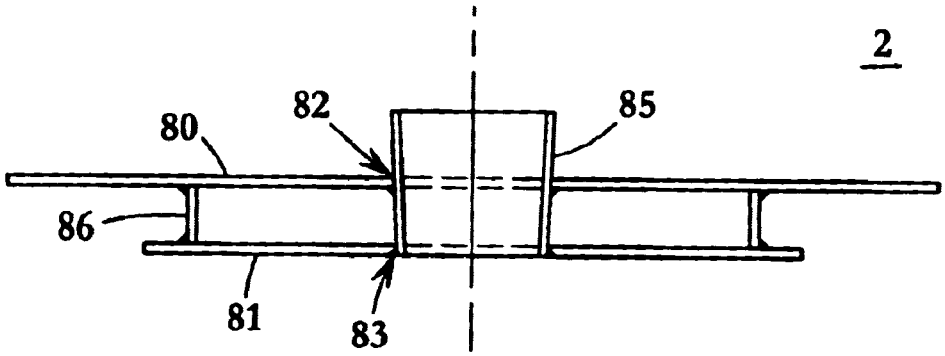
Figure 10:
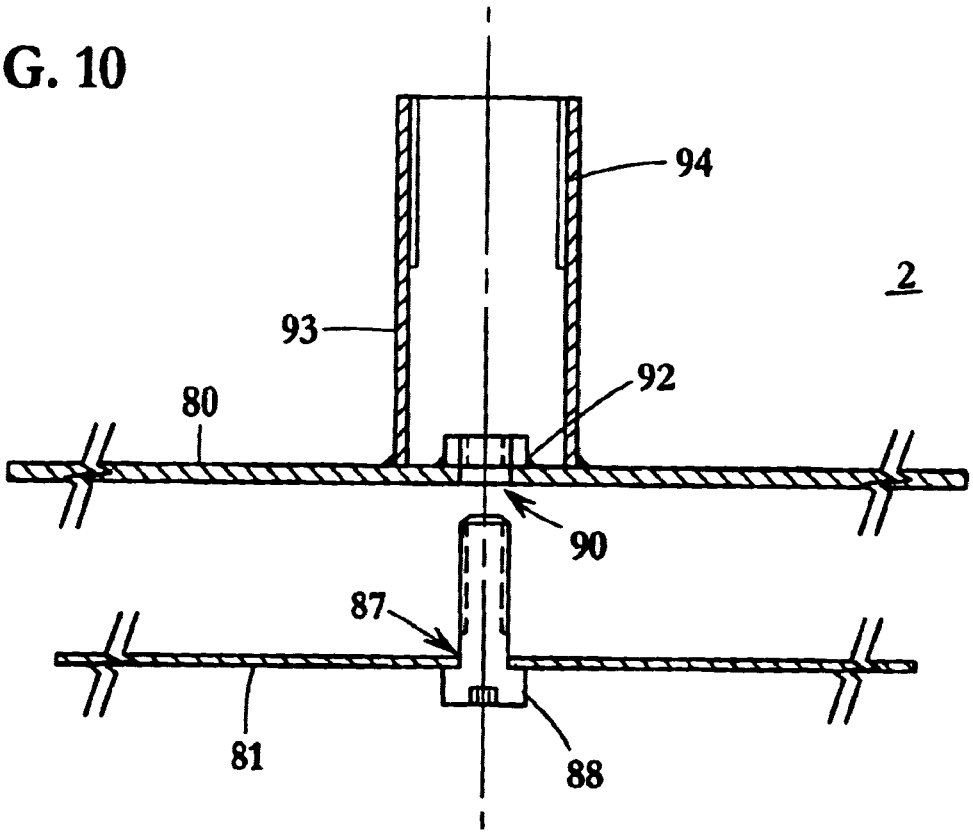
Figure 12:
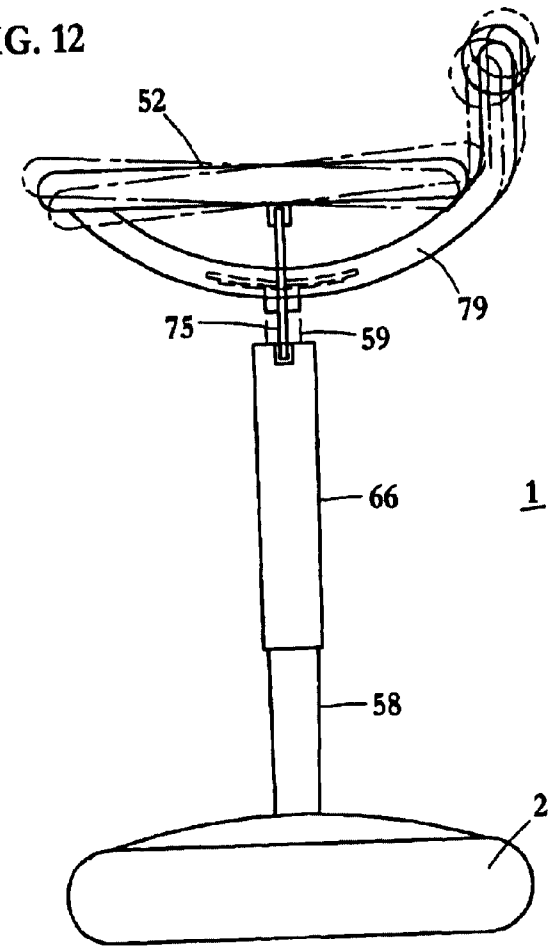
Figure 11:
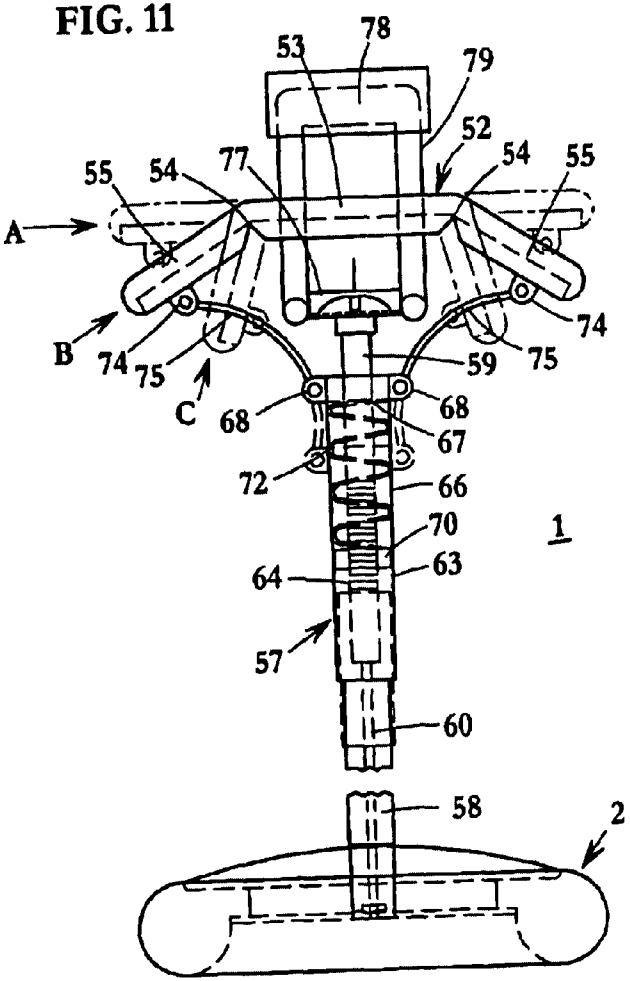
Figure 13:
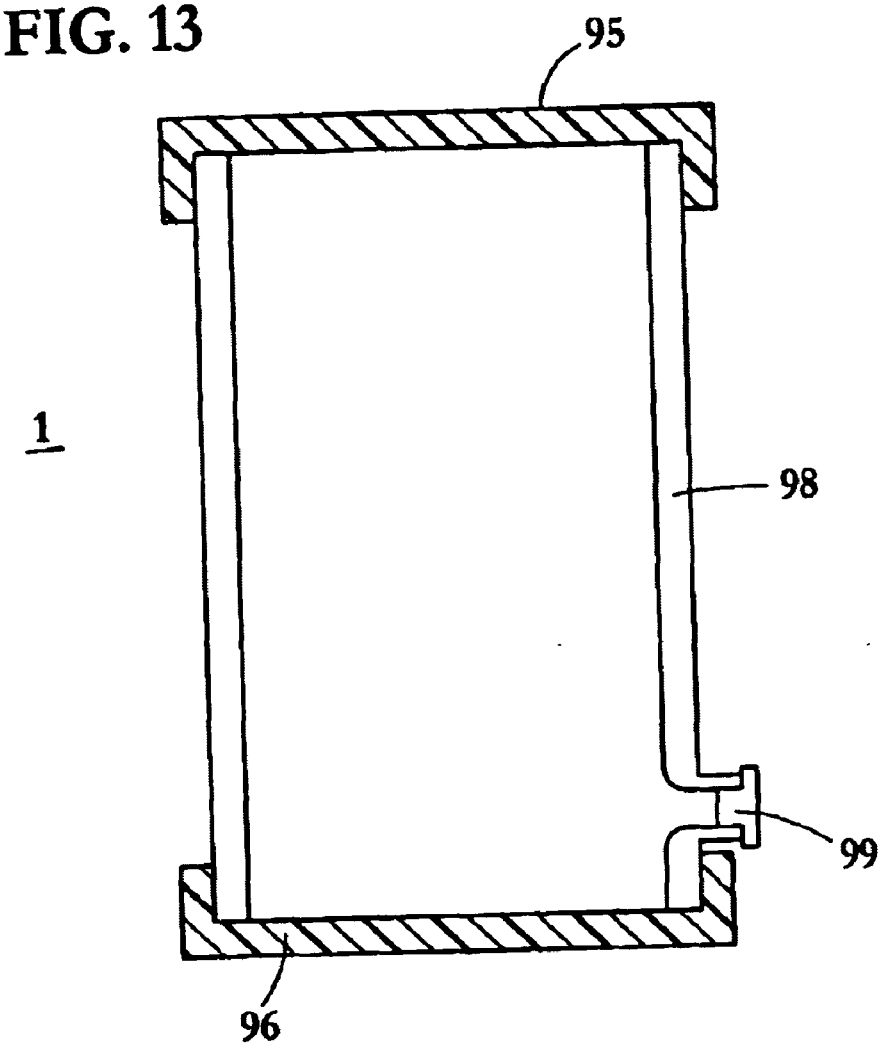
Figure 14:
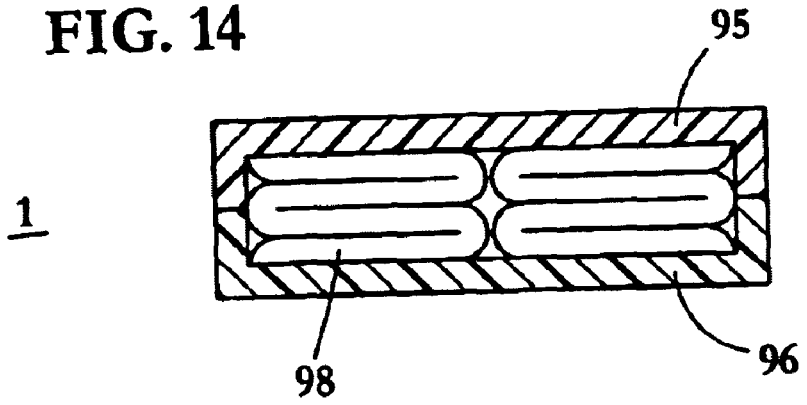

Further advantages of the invention ensue from the dependent claims and from the following description, in which the invention is explained in greater detail by means of an exemplary embodiment represented in the schematic drawings. Shown are in:

FIG. 1, a seating arrangement, partially in cross section and in a view from above, FIG. 2, the same seating arrangement with a cross section of the elastic support element, FIG. 3, the fastening of the seating element on the support leg, FIGS. 4*a*–4*d*, the saddle-shaped seat of the seating element, FIG. 5, a view from above on a first variation of the support element, FIG. 6, a cross section through the support element in FIG. 5, FIG. 7, a view from above on a second variation of the support element, FIG. 8, a cross section through the support element in FIG. 7, FIG. 9, a third variation of the support element in cross section, FIG. 10, a fourth variation of the support element in cross section, FIG. 11, a partial cross section through a further embodiment of the seating arrangement, FIG. 12, a lateral view of the seating arrangement in FIG. 11, FIG. 13, a fifth, particularly simple embodiment of the seating arrangement, and FIG. 14, the seating arrangement in FIG. 13 in the folded state.

A seating arrangement 1 with an elastic support element 2, a support leg 3 and a seating element 4 is represented in FIG. 1 partially in cross section and partially in a view from above. The elastic support element 2 essentially consists of an upper circular disk 6 and a lower circular disk 7, which are connected with each other by means of flexible ties 8, for example long-wearing textile ribbons, and of a toroidal support body, in particular a tire 9 with an inner tube 10. The tire 9 can be made of pressure-setting material, such as polyurethane, or of an elastomer, such as natural caoutchouc or silicon caoutchouc. On their outsides, the disks 6 and 7 have a widened edge 11, or 12, which is supported on the upper, or lower, tire bead 16 and 17. The flexible ties 8 are fastened to the disks 6 and 7 by means of rivets 14 or the like and define the greatest distance between the disks 6 and 7. The disks 6 and 7 are pushed apart by the tire 9, i.e. they are seated, movable in respect to each other. As shown in FIG. 2, the leg 3 is passed through a circular opening 18 of the disk 6 and on the inside has a circular disk 19 fastened thereon. An annular disk 10 is provided on the outside, which has been pushed with an exact fit on the support leg 3 and is connected by means of screws 21 with the circular disk 19. By means of this the support leg 3 is rigidly, i.e. at a fixed angle of 90 , connected with the support disk 6. In its upper end area, the metallic support leg 3 has an interior thread-not visible here-into which a spindle 23 has been screwed, which in turn is connected with the seating element 4. The seating element 4 essentially consists of a circular disk 26 (see FIG. 3) fastened on a saddle support 25. The saddle support 25 has a curved tube element 28 made of metal, which is fastened, for example by means of a welded connection, to the spindle 23. A quick-clamping connection 30 with a lever 31 is provided on one end of the tube element 28. A longer tube 33, curved with the same radius, is provided in the tube element 28, and has saddle-shaped fastening plates 34 on its ends. In this way the tube element 28 and tube 33 constitute a tilting displacement for the seating element, or the saddle 4. The circular disk 26 is fastened on the saddle support 25 by means of screws 35. As visible in FIG. 4, the saddle 4 can be continuously adjusted in various (represented by dashed lines) positions and can be fixed therein. However, similar to a bicycle seat, the fastening can also be snapped into different positions and fixed in place by means of a screw and nut.

The circular disk 26 is made of a long-wearing material, such as leather, and has four parallel slits 38 (see FIG. 4). A saddle shape is created when this circular disk 26 is compressed in the edge areas 39 in the axis 40 parallel with the slits 38 with a defined force $F_1$ (FIG. 4*b*), and also laterally with a force $F_2$ (FIG. 4*c*). In this case, FIG. 4*c* represents a cross section along the line A—A in FIG. 4*b*. The harder the two edge areas 39 are pressed against each other, the more distinct the saddle shape becomes. Thus, the distance between the two fastening plates 34 and their roundness, together with the diameter of the circular disk 26, define the final shape of the saddle.

The functioning of the seating arrangement 1 described in the above FIGS. 1 to 4 is as follows:

The user is forced to sit astride on the saddle 4, i.e. he always places his legs on the floor spread at an angle of approximately 70 to 110. Since the support element 2 is made elastically, the support leg 3 can be tilted forward and backward (represented in dashed lines in FIGS. 1 and 2), wherein the tire 9 more or less limits these movements, depending on the interior pressure. Because of the circular-symmetrical embodiment of the support element 2, no movement direction of the support leg 3 is preferred, and the seating arrangement can also be moved in a circle. If extreme tilting movements are performed, wherein the tire 9 is even partially lifted off the floor, the tire 9 provides sufficient stability on the floor, i.e. it is almost impossible for the chair to slip away, such as is the case with conventional rubber balls. Since the seating arrangement 1 can in fact roll off on the tire 9, there is no transition from a tilting moment, such as is the case with single-leg chairs with a flat plate as the support element. Because of the special embodiment of the seating arrangement 1, the back is located always at least approximately in the axis of the support leg 3, so that the correct seated position is automatically taken, i.e. the user again and again performs small circular movements, which cause strengthening of the muscles of the back. A sliding transition between slight circular movements and larger circular movements is obtained by means of the correct pressure of the tire 9. The slight circular movements or the up and down seesawing movements are perceived to be very pleasant, since the user always moves around a position of equilibrium. The larger circular movements impart a feeling of insecurity to the balance mechanism, so that they are rather not being performed. This forces the user—with a few exceptions—to take up the correct seating position, if possible.

A view from above is now represented in FIG. 5, and a cross section in FIG. 6, of a variation of the elastic support element 2, wherein the toroidal support body or tire 9 is clamped between a flat disk 42 and a thick, slightly cambered disk 43. This disk 42 is fastened by means of screws 44 on the thick disk 43, so that the two disks 42 and 43 constitute a sort of rim. As can be seen, the disk 42 is arranged approximately at the height of the center of the tire 9, so that sufficient ground clearance exists for permitting seesawing movements of the chair. In a further embodiment, both disks 42 and 43 can be embodied as flat steel disks of the same diameter. The correct movement characteristics can be optimally set for the user by the correct choice of the disk diameters of the disks 42 and 43 and by the ground clearance of the tire 9 and its hardness (air pressure).

A further variation of the elastic support element 2 is furthermore represented in a view from above in FIG. 7, and in cross section in FIG. 8, wherein the tire 9 is embodied as a rubber ring 45. In this case the rubber ring 45 can be made of solid rubber, or can be hollow in the interior, in which case a valve is possibly provided for being able to set the air pressure inside the rubber ring 45 and thereby the hardness of the rubber ring. This rubber ring 45 has now been inserted into an annular groove 46 of a cambered disk 47, wherein the circular groove 48 is embodied over an angle of slightly greater than 180, for example 190, so that it is held by the edges 48 of the annular groove 46, which project slightly inward. A central hole 49 with a tube 50 with an interior thread for the support leg, not shown here in detail, is furthermore provided in the disk 47.

A further variation of the support element 2, but without a tire 2, is represented in FIG. 9. Here, the support element 2 consists of an upper disk 80 of a larger diameter and of a lower disk 81 of a lesser diameter. The two disks 80 and 81 are made of stainless steel, for example, and each has a central bore 82 or 83, through which a cone-shaped tube section 85 passes. The tube section 85 is welded to the two disks 80 and 81 in the area of the central bores 82, or 83. A ring 86 of a somewhat lesser diameter as that of the lower disk 81 is furthermore provided concentrically in respect to the tube section 85 and is also welded to the two disks 80 and 81.

A further variation of the arrangement of the support elements 2 similar to the one in FIG. 9 is represented in FIG. 10. In this case, a screw 88 is pushed through a central bore 87 through the lower disk 81 and is welded to the latter. A central bore 90in the upper disk 80 is centered therewith, and a screw nut 92 is welded to it on the opposite side. A slightly conical tube section 93 with an interior thread 94 is welded to the upper disk 80 for fastening the support tube, not represented here. With this variation it is possible to set the distance between the two disks 80 and 81.

It is understood that with the above two variations of the support element 2 it is possible to obtain a limited movement characteristic. Depending on the interior pressure in the tire 9 it is possible to achieve an elasticity of greater or lesser extent.

A seating arrangement, or a single leg chair 1 with the elastic support element of the embodiments in FIGS. 5 and 6 is represented in a lateral view in FIG. 11, and partially in cross section in FIG. 12. This chair has an adjustable seating element 52, which has a center part 53 and lateral wings 55, hingedly fastened to the latter by means of hinges 54 or the like. The support leg 57 is embodied as an encapsulated gas-pressure spring, known per se, which consists of a support tube 58, a telescope tube 59 and a plunger 60. In this case the cylinder of the gas-pressure spring is housed in the support tube 58. A tube-shaped extension 63 with an exterior thread 64 is provided at the upper end 62 of the support tube 58. A cover tube 66 is provided between the support tube 58 and the telescope tube 59, on whose upper end an exterior ring 67 with eyes 68 is fastened. The support tube 58 and the cover tube 66 can be produced from steel tubing. However, the support tube 58 and the cover tube 66 appear particularly elegant if made of wood, in particular plywood, and if the two end areas are provided with a metal cap, preferably of stainless steel. These two tubes 58 and 66 have a very high degree of mechanical stability, because of which they assure the required mechanical stability. An interior ring 70 with an interior thread is screwed on the extension 63 and is in turn fastened on the inside of the cover tube 66. Moreover, one end of a helical spring 72 is fastened to the exterior ring 67, and the other end to the interior ring 70. At the lowest height setting of the chair this helical spring 72 acts as a compression spring, and at the highest height setting as a tension spring. Moreover, eyes 74 are also provided at the lateral wings 55, and circularly curved connecting rods 75 between the eyes 68 and 74. As can be furthermore seen, a support 76 for the seat 52 is fastened to the telescope tube 59, i.e. at the center part 53. The support 76 consists of a slight curved connecting plate 77 and a U-shaped round rod 78 with two parallel, circularly curved legs 79, on which the center part 53 is supported. The two curved legs 79 are welded to the connecting plate 77. The connecting plate 77 has a longitudinal slit, so that the support 76 is displaceably, and also fixable by means of a screw nut or wing nut, fastened on a threaded rod of the telescope tube 59, so that the relative inclined position of the seat 53 can be adjusted. (see FIG. 12).

The functioning of the adjustable seating element 52 is as follows: in the lowest position of the support leg, the lateral wings 55 are pushed upward by the helical spring 72 acting as a pressure spring and the connecting rods 75, i.e. there is a flat seat (position A-shown in dashed lines). If now the telescope tube 53 is moved upward by the gas spring, the helical spring 59 expands, but over a much shorter distance than the telescope tube,59, so that the lateral wings 55 are pulled slightly downward via the connecting rods 75 (position B-drawn in solid lines). If the telescope tube 59 is moved completely upward, the helical spring 72 is extended, so that it now acts as a tension spring and pulls the lateral wings 55 completely downward (position C-represented in dashed lines). Thus, the helical spring 72 causes the compensation between the essentially longer path of the telescope tube 59 and the much shorter path of the two lateral wings 55, i.e. it has a buffer function. In this way the helical spring 72 and the connecting rods 75 constitute a kind of mechanical transmission. Setting the spring pressure of the helical spring 72 in the position A can be done by means of the interior ring 70, in that the support element 2 with the support tube 58 with the extension 63 are turned. By means of this the distance between the inner ring 70 and the outer ring 67 can be increased, or decreased, because of which the helical spring 72 is more or less compressed. In the representation in FIG. 11, the various heights to which the chair 1 can be set are not. immediately visible. Furthermore, the customary lever provided in the area of the seating element 52 has not been represented here. In place of the above described mechanical transmission it is.also possible to accomplish this by means of a scissors mechanism. It is of course also possible to omit the above described mechanical transmission and to perform: the setting between the flat and the saddle-shaped forms purely manually.

One skilled in the art will understand that the tire 9 does not necessarily have an inner tube 10, but can also be embodied without a tube with a suitable seal between the two disks 6 and 7. Another embodiment of the elastic support element 2 is naturally: also possible. For example, several spherical bodies can be provided between the disks 6 and 7, in which case the flexible ties 8 should be arranged on the outside and the inside around the spherical bodies so that these are maintained in a sort of net. Other clamping fastenings than, for example those in FIGS. 5 and 6, can be provided here. The spherical bodies can in this case be balls inflated with air, or are embodied to be solidly made of an elastic material, such as natural caoutchouc, silicon caoutchouc, or the like.

A very simple embodiment of the seating arrangement 1 in accordance with the above described principle is represented in FIGS. 13 and 14, wherein an upper, lid-like disk 95 and a lower, identically embodied lid-like disk 96 are provided, between which a cylinder-shaped, rubber-elastic support body 98 is provided, which can be inflated by means of a valve 99. In this case the upper disk 95 is used as the seating element. The mobility of this seating arrangement 1 is set by means of the selected air pressure in the cylinder-shaped support body 98. As can be seen in FIG. 14, such a seating arrangement 1 can be easily folded up, so that it is used mainly in the recreational sphere (camping, picnicking and the like). For example, in the present embodiment the two lid-like disks are made of a hard plastic material, and the support body 98 of a pressure-setting plastic material or an elastomer.

What is claimed is:

1. A seating arrangement comprising:

an elastic support element;

a connecting element forming a support leg; and a seating element, wherein the support element comprises an upper disk and a lower disk which are approximately parallel and spaced apart from each other, and the support element further comprises an elastic, approximately toroidal-shaped tire, wherein the tire serves as a support body, the upper disk and the lower disk are approximately circular shaped, the tire is maintained between the upper circular-shaped disk and the lower circular-shaped disk and forms a rim, the upper circular-shaped disk and the lower circular-shaped disk each define an edge, and each edge is supported on an upper and lower bead, respectively, of the tire, the upper disk defines a diameter larger than that of the lower disk, and the lower disk, when the support element rests on a floor, is at least partially lifted off the floor to form a space with respect to the floor.

2. The seating arrangement in accordance with claim 1, wherein the tire is made of a pressure-setting plastic material.

3. The seating arrangement in accordance with claim 2, wherein the tire includes an inner tube.

4. The seating arrangement in accordance with claim 1, wherein the seating element is saddle-shaped.

5. The seating arrangement in accordance with claim 4, wherein the saddle shaped seat is fastened on the support leg by means of a tilting adjustment device.

6. The seating arrangement in accordance with claim 5, wherein the tilting adjustment device includes a tube element in the shape of an arc of a circle, and a tube in the shape of an arc of a circle, and wherein the tube can be displaced in the tube element.

7. The seating arrangement in accordance with claim 1, wherein the tire is made of an elastomer.

8. The seating arrangement in accordance with claim 1, wherein when the support element rests on the floor, the space formed with respect to the floor permits seesawing movements of the seating element.

9. The seating arrangement in accordance with claim 8, wherein the tire is made of a pressure-setting plastic material.

10. The seating arrangement in accordance with claim 9, wherein the tire includes an inner tube.

11. The seating arrangement in accordance with claim 8, wherein the seating element is saddle-shaped.

12. The seating arrangement in accordance with claim 11, wherein the saddle shaped seat is fastened on the support leg by means of a tilting adjustment device.

13. The seating arrangement in accordance with claim 12, wherein the tilting adjustment device includes a tube element in the shape of an arc of a circle, and a tube in the shape of an arc of a circle, and wherein the tube can be displaced in the tube element.

14. The seating arrangement in accordance with claim 8, wherein the tire is made of an elastomer.

* * * * *